US008695731B2

(12) United States Patent
Downton et al.

(10) Patent No.: US 8,695,731 B2
(45) Date of Patent: Apr. 15, 2014

(54) DRILLING SYSTEM

(75) Inventors: Geoffrey C. Downton, Minchinhampton (GB); Sami Iskander, Reading Berkshire (GB); Robert Utter, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 525 days.

(21) Appl. No.: 12/744,276

(22) PCT Filed: Nov. 19, 2008

(86) PCT No.: PCT/US2008/083957

§ 371 (c)(1), (2), (4) Date: Sep. 6, 2011

(87) PCT Pub. No.: WO2009/067468

PCT Pub. Date: May 28, 2009

(65) Prior Publication Data

US 2011/0308862 A1 Dec. 22, 2011

(30) Foreign Application Priority Data

Nov. 21, 2007 (GB) ..... 0722755.6

(51) Int. Cl.
*E21B 7/04* (2006.01)

(52) U.S. Cl.
USPC ..... 175/73; 175/76

(58) Field of Classification Search
USPC ..... 175/61, 73, 74, 75, 76
See application file for complete search history.

(56) References Cited

U.S. PATENT DOCUMENTS

| | | | | |
|---|---|---|---|---|
| 6,318,470 | B1 | 11/2001 | Chang et al. | |
| 6,467,557 | B1 | 10/2002 | Krueger et al. | |
| 6,516,898 | B1 | 2/2003 | Krueger | |
| 6,863,137 | B2 | 3/2005 | Terry et al. | |
| 7,174,974 | B2 | 2/2007 | Bloom et al. | |
| 7,185,716 | B2 | 3/2007 | Bloom et al. | |
| 7,311,151 | B2 | 12/2007 | Chitwood et al. | |
| 2003/0075361 | A1 | 4/2003 | Terry et al. | |
| 2007/0107941 | A1* | 5/2007 | Fillipov et al. | 175/57 |
| 2007/0261887 | A1* | 11/2007 | Pai et al. | 175/61 |
| 2011/0088951 | A1* | 4/2011 | Orban et al. | 175/61 |

FOREIGN PATENT DOCUMENTS

| | | |
|---|---|---|
| EP | 1640556 | 6/2008 |
| GB | 2388132 | 11/2003 |
| WO | 01/09478 | 2/2001 |
| WO | 01/61143 | 8/2001 |
| WO | 2004/083595 | 9/2004 |

* cited by examiner

*Primary Examiner* — William P Neuder
(74) *Attorney, Agent, or Firm* — Chadwick A. Sullivan; Brigitte Echols

(57) ABSTRACT

A drilling system comprising a rotatable drill pipe 12 connected to a tractor unit 10, and a steerable drilling system 18, 20, 22, connected to and movable by the tractor unit 10.

13 Claims, 1 Drawing Sheet

DRILLING SYSTEM

Figure 1:
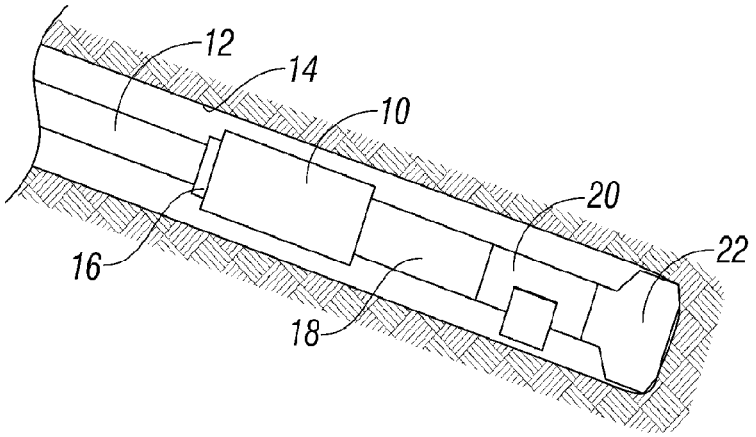

This invention relates to a drilling system, and in particular to a drilling system for use in the formation of bore holes for the subsequent extraction of hydrocarbons.

One form of steerable drilling system typically used in the formation of bore holes comprises a drill string or drill pipe carrying a bias unit. The bias unit is operable to hold the drill pipe in a desired eccentric position relative to the adjacent part of the bore hole. The drill pipe further typically carries a down hole motor arranged to drive a drill bit for rotation. The bias unit and motor are typically hydraulically powered using drilling fluid or mud supplied under pressure along the drill pipe.

In use, a weight-on-bit (WOB) loading is applied via the drill pipe to the bit which, in combination with the rotation of the bit, serves to cause the bit to gouge, scrape or abrade material from the end of the bore hole, increasing the length of the bore hole.

Operation of the bias unit can be used to steer the drill bit such that the bore hole is drilled along a desired path.

It is an object of the invention to provide an alternative form of drilling system.

According to the present invention there is provided a drilling system comprising a rotatable drill pipe connected to a tractor unit, and a steerable drilling system connected to and movable by the tractor unit.

Such an arrangement is advantageous in that, in use, the drill pipe can be rotated continuously, if desired, thereby reducing the risk of the drill pipe sticking, whilst the tractor unit provides a stable platform for the steerable drilling system.

The steerable drilling system conveniently includes a down hole motor.

The provision of the tractor unit serves to limit or control the transmission of movement and forces between the drill pipe and the steerable drilling system. In particular, it reacts the torque generated by the operation of the motor rather than transmitting this loading to the drill pipe. Likewise, bit induced reactive torques are not transmitted to the drill pipe, reducing vibration thereof.

The tractor unit and steerable drilling system may be hydraulically powered, for example using fluid supplied through the drill pipe. Alternatively or additionally rotation of the drill pipe and/or drill pipe transmitted WOB loadings may be used to power these components. Further, they may be electrically powered. The tractor unit and steerable drilling system need not use the same power source.

The tractor unit may incorporate an energy conversion arrangement, for example to convert movement thereof into hydraulic energy or the reverse. Such an arrangement may be automatically controlled by a surface or down hole located control unit, or may be manually controlled.

Sensors may be provided on the tractor unit or elsewhere between the drill pipe and the drill bit to allow measurement while drilling. For example, the engagement between the tractor unit and the bore hole wall may be used to indicate the shape and diameter of the bore hole, bore hole stability parameters, and to provide pressure whilst drilling measurements.

Figure 2:
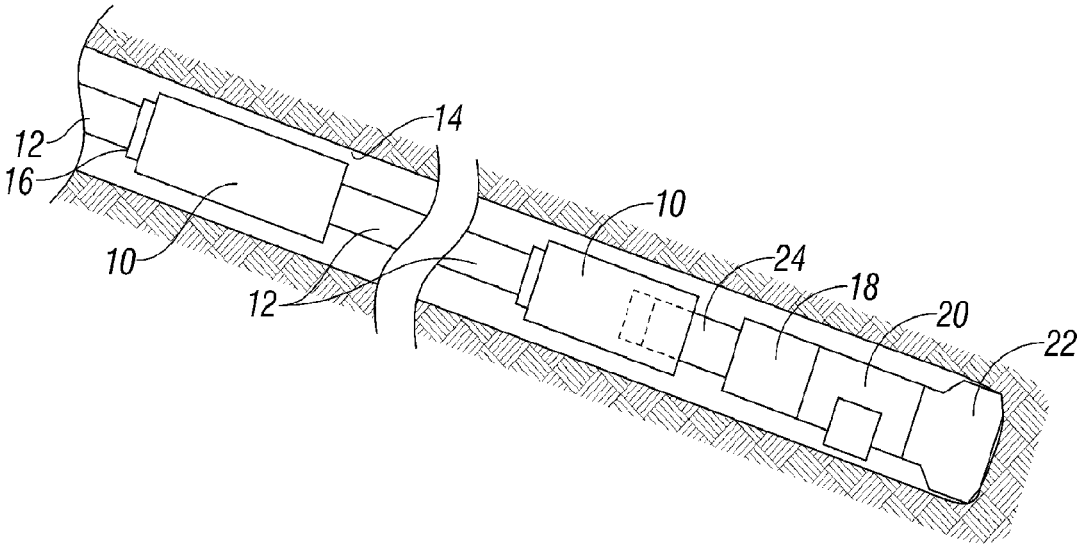

The invention will further be described, by way of example, with reference to the accompanying drawings, in which:

FIG. 1 is a diagrammatic illustration of part of a drilling system in accordance with an embodiment of the invention; and FIG. 2 is a view similar to FIG. 1 illustrating an alternative configuration.

The drilling system illustrated in FIG. 1 comprises a tractor unit 10 connected to a lower end of a drill pipe 12. The drill pipe 12 extends along the length of a bore hole 14 to the surface. The drill pipe 12 is arranged to be rotated from the surface, in use, and is arranged to be supplied with drilling fluid or mud under pressure. Typically, the drill pipe 12 is rotated slowly to avoid sticking.

The drill pipe 12 could take a range of forms. For example it could comprise coiled tubing or another piping device.

The tractor unit 10 is provided with a coupling arrangement 16 whereby the drill pipe 12 is conducted to the tractor unit 10. The coupling arrangement 16 is arranged so as to allow the mud supplied through the drill pipe 12 to be supplied to the tractor unit 10. It is further arranged such that, in normal use, rotation of the drill pipe 12 is not transmitted to the tractor unit 10, but that when desired its operating mode can be switched so as to cause the tractor unit 10 to rotate with the drill pipe 12, or to rotate at a lower speed than the drill pipe 12. Conveniently, sensors are operable to monitor the relative motion between the drill pipe and the tractor unit, and to store or transmit this information to a control unit where it may be used, for example, to control the operation of the system in such a manner as to dampen undesired movements or vibrations.

By permitting the drill pipe 12 to rotate independently of the tractor unit 10, the drill pipe 12 can be rotated continuously, if desired, reducing the risk of the drill pipe 12 sticking. Further, the rotation of the drill pipe 12 may be used to agitate the fluids passing along the borehole, thereby reducing the build-up of cutting therein. Although the coupling arrangement 16 allows independent rotation, it is preferably lockable so that the drill pipe 12 can be used to apply torques to the tractor unit 10, for example to assist in releasing it if it becomes jammed or trapped in position. The system is preferably configured to default to this setting in the event of a power failure.

The tractor unit 10 supports a down hole motor 18 conveniently in the form of a mud powered motor. The output of the mud powered motor 18 is transmitted to a steering control unit 20 which, in turn, is connected to a drill bit 22. It will be appreciated that in use, the operation of the motor 18 forces the drill bit 22 to rotate, the steering control unit 20 controlling the orientation or position occupied by the drill bit 22, thereby controlling the direction in which the bore hole is extended, in use.

As the tractor unit 10 supports the motor 18, steering control unit 20 and drill bit 22, and as mentioned below can be used to apply a weight on bit (WOB) load to the drill bit 22, rather than using the drill pipe 12 to support these components and apply these loads, the drill pipe 12 can be thinner walled and of increased diameter compared to normal, being sufficiently strong to support its own weight, bear the applied fluid pressures, and to carry the applied loadings if used to pull the tractor unit 10.

A gear box may be provided to allow the rotary speed of the bit 22 to be increased. A fluid coupling or epicyclic gear box or a constant velocity gear box may be provided to regulate the torque and rotary speed, and hence the power to the bit 22.

The tractor unit 10 grips the wall of the bore hole 14 and is movable along the length of the bore hole 14 by virtue of an internal traction system. The traction system can be inch worm based, or alternatively may comprise tracks, wheels, differential pistons, rolling toroid or screw operated arrangements. Further, any combination of these techniques could be used to drive the tractor unit 10 for movement relative to the bore hole 14. It will be appreciated that, in use, the operation of the traction system of the tractor unit 10 can be used to apply a WOB load to the drill bit 22, and that the application of the WOB load in combination with the rotation of the drill bit 22 causes the drill bit 22 to scrape, abrade or gouge material from the end of the bore hole 14, increasing or extending the axial length thereof in a direction controlled by the steering control unit 20. The tractor unit 10 controls advancement of the bit in accordance with rules contained in a control system. The rules may be selected to take into account the type of bit, characteristics of the formation, drilling and bore hole conditions and the mud system, and operate in accordance with information derived from appropriate sensors. The unit 10 further controls the rate of penetration of the bit 22, and controls rotary speed by controlling the operation of the motor 18. The material removed by the drill bit 22 is typically washed away from the lower end of the bore hole 14 by a return flow of drilling fluid or mud which travels towards the surface along an annular passage defined between the drill pipe 12 and the wall of the bore hole 14.

The provision of the coupling arrangement 16 in combination with the traction system of the tractor unit 10 results in motor and bit induced reaction forces being transmitted to the formation rather than to the drill pipe 12, reducing the vibration thereof.

A mud activated, axially extending piston 24 (see FIG. 2) may be provided on the tractor unit 10 to apply and control the WOB loading to the bit 22, and/or to isolate the motor 18, steering control unit 20 and drill bit 22 from axial vibrations, for example as may occur in the drill pipe 12 is used to apply the WOB loadings. The piston 24 may be controlled using a down hole located proportional valve controlled using the outputs of appropriate sensors by a down hole or surface located computer. In such an arrangement, the traction system of the tractor unit 10 reacts the loading applied by the piston 24.

Where the WOB loading is applied either by the tractor unit 10 as a whole or by such a piston 24, or by a combination of these effects, the magnitude of the applied WOB loading is conveniently controlled in accordance with the output of a control algorithm which takes into account factors such as the overall drilling speed, rock types, bit design, prevailing shock and vibration conditions, and bit vibrations.

It is envisaged that the primary power source for the tractor unit 10 and the steerable drilling system comprising the motor 18 and steering control unit 20 will be hydraulically derived, using the mud supply delivered through the drill pipe 12. Electrical power may be generated by using the mud supply to drive a turbine which, in turn drives an electrical generator. However, it will be appreciated that alternative drive techniques may be used. For example, the rotation of the drill pipe 12 relative to the tractor unit 10 could be converted to electrical or hydraulic energy by using the relative rotation to drive an electrical generator or to drive a mud motor to pressurise a downhole fluid to apply hydraulic power. By controlling the operation of the generator, the torsional loading of the drill pipe can be controlled and, if desired, used to transmit signals to the surface. If desired, it may be possible to positively drive to the lower end of the drill pipe to enhance this effect. Alternatively, weight-on-bit loadings applied by the drill pipe 12 could be used to supply power. A further alternative is to provide electrical power via an electrical cable wired drill pipe, or a composite tubing which can carry high current conductors. Of course, any combination of these techniques could also be used. Where an energy conversion system is provided, it may be automatically controlled via a down hole located controller or a surface located controller. Further, it may be manually controlled in part or in full by a surface located operator.

As mentioned hereinbefore, the tractor unit 10 can be driven along the length of the bore hole 14, or held against movement in a desired position within the bore hole 14, and may be used to apply a WOB loading to the drill bit 22. The traction system of the tractor unit 10 may further be used to secure the tractor unit 10 against rotary movement relative to the bore hole 14. It will be appreciated that monitoring of the axial position of the tractor unit 10 relative to the bore hole 14 can be used to provide an indication of the position of the drill bit 22. Further, by monitoring the engagement of the tractor unit 10 with the wall of the bore hole 14, the diameter and shape of the bore hole 14 can be monitored, and pressure whilst drilling measurements may be made. Monitoring of the distortion of the mud cake may be used to determine stability parameters for the bore hole 14.

As mentioned hereinbefore, a return flow of drilling fluid or mud can be used to wash away the material removed by the drill bit 22. If desired, the tractor unit 10 may form a pressure seal with the wall of the bore hole 14, blocking the return flow. Passages or valves may be provided in the tractor unit 10 to control the return flow of fluid under such circumstances.

The steerable drilling system may take a range of forms. For example, the steering control unit 20 may comprise a bias unit operable to apply a sideways acting load in a desired direction to the drill bit 22 urging it in a desired direction. Alternatively, the steering control unit 22 could incorporate a bent housing and a mechanism operable to orientate the bent housing in a desired direction so as to point the drill bit 22 in a desired direction. Other systems are possible. For example, a non-rotating sliding sleeve rotary steerable system could be used, or other steering drilling systems incorporating push-the-bit, point-the-bit, or combined steering principles could be used.

The drill bit 22 may take a wide range of forms. For example it may comprise a conventional rotary drag type drill bit. However, other forms of bit may be used.

A wired drill pipe system may be used to permit data communication between the surface and the tractor unit 10. Such a system may also, or alternatively, be used to supply electrical power to the tractor unit 10, as mentioned hereinbefore.

It may be desirable to incorporate one or more additional similar tractor units along the length of the drill pipe (as shown in FIG. 2) to assist in control in extended reach applications. The tractor units would preferably be controlled in unison, preferably using a wired drill pipe connection to achieve the necessary communication speed, so as to achieve the advantages outlined hereinbefore.

In summary, the tractor unit 10 provides a stable base for drilling and steering. Consequently, higher levels of ROP can be achieved and steering can be controlled more accurately. ROP improvements are both direct, as a result of increased instantaneous speed arising from improved control over WOB, torque and rotary speed of the bit 22, and by avoiding or reducing downtime when recovering from problems caused by drilling from less stable platforms.

It will be appreciated that wide range of modifications and alterations may be made to the arrangement described hereinbefore without departing from the scope of the invention.

The invention claimed is:

1. A drilling system comprising:

a rotatable drill pipe connected to a tractor unit by a coupling that permits the drill pipe to rotate independent of the tractor unit thereby permitting continuous rotation of the drill pipe; and a steerable drilling system comprising a down hole motor connected to a drill bit, wherein operation of the motor rotates the drill bit, wherein the steerable drilling system is connected to and movable by the tractor unit to apply weight to the drill bit.

2. The system according to claim 1, wherein the tractor unit and/or the steerable drilling system are hydraulically powered.

3. The system according to claim 2, wherein the hydraulic power is supplied using fluid supplied through the drill pipe.

4. The system according to claim 1, wherein rotation and/or weight on bit (WOB) loadings are used to generate electrical or hydraulic energy to power at least one of the tractor unit or the steerable drilling system.

5. The system according to claim 1, wherein the tractor unit and the steerable drilling system are electrically powered.

6. The system according to claim 5 wherein electrical energy is supplied via at least one of a cable, a wired drill pipe arrangement, and conductors provided in a composite drill pipe.

7. The system according to claim 1, further comprising sensors provided on the tractor unit or elsewhere between the drill pipe and the drill bit to allow measurement while drilling.

8. The system according to claim 7 wherein the sensors permit monitoring of at least one of the diameter and shape of the borehole stability parameters of the borehole.

9. The system according to claim 1, wherein the tractor unit incorporates bore hole engaging traction means.

10. The system according to claim 9, wherein the traction means comprises an inch-worm arrangement, tracks, wheels, screws or pressure differential piston means.

11. The system according to claim 1, wherein the coupling between the drill pipe and the tractor unit is controllable to selectively rotationally lock the drill pipe and the tractor together to transmit torque from the rotating drill pipe to the tractor unit.

12. The system according to claim 1, further comprising a piston provided on the tractor unit and operable to move the steerable drilling system.

13. The system according to claim 1, further comprising at least one further tractor unit located part-way along the drill pipe.

* * * * *